US009938035B2

(12) United States Patent
Block

(10) Patent No.: US 9,938,035 B2
(45) Date of Patent: Apr. 10, 2018

(54) EXPANDABLE BEVERAGE CONTAINER CARTON ADAPTED TO RECEIVE ICE THEREIN

(71) Applicant: The C.W. Zumbiel Company, Hebron, KY (US)

(72) Inventor: Steven J. Block, Amelia, OH (US)

(73) Assignee: The C.W. Zumbiel Company, Hebron, KY (US)

( * ) Notice: Subject to any disclaimer, the term of this patent is extended or adjusted under 35 U.S.C. 154(b) by 0 days.

(21) Appl. No.: 15/287,777

(22) Filed: Oct. 7, 2016

(65) Prior Publication Data

US 2017/0144792 A1 May 25, 2017

Related U.S. Application Data

(60) Provisional application No. 62/259,694, filed on Nov. 25, 2015.

(51) Int. Cl.

| | |
|---|---|
| ***B65D 5/355*** | (2006.01) |
| ***B65D 5/40*** | (2006.01) |
| ***B65D 25/30*** | (2006.01) |
| ***B65D 5/02*** | (2006.01) |

(52) U.S. Cl.

CPC ..... *B65D 5/0005* (2013.01); *B65D 5/0227* (2013.01); *B65D 5/0263* (2013.01); *B65D 5/40* (2013.01); *B65D 25/30* (2013.01)

(58) Field of Classification Search

CPC ..... B65D 5/0263; B65D 5/40; B65D 25/30

USPC ..... 229/117.16, 101, 103, 138, 243, 240, 229/186, 244, 117.12, 117.13; 206/427, 206/545

See application file for complete search history.

(56) References Cited

U.S. PATENT DOCUMENTS

| | | | | |
|---|---|---|---|---|
| 2,810,506 | A * | 10/1957 | Kessler | B65D 5/2052 229/101 |
| 5,101,642 | A | 4/1992 | Alexandrov | |
| 5,307,986 | A * | 5/1994 | Schuster | B65D 5/0005 229/101 |
| 5,495,727 | A | 3/1996 | Strong et al. | |
| 7,601,111 | B2 | 10/2009 | Sutherland et al. | |
| 7,611,042 | B2 | 11/2009 | Bates et al. | |
| 7,669,755 | B2 | 3/2010 | Smalley | |
| 7,699,215 | B2 | 4/2010 | Spivey, Sr. | |
| 7,717,318 | B2 | 5/2010 | Brand | |
| 7,748,603 | B2 | 7/2010 | Fogle et al. | |
| 7,806,314 | B2 | 10/2010 | Sutherland | |
| 7,832,621 | B2 | 11/2010 | Smalley | |
| 7,832,622 | B2 * | 11/2010 | Spivey, Sr. | B65D 5/4608 229/117.16 |
| 7,900,816 | B2 | 3/2011 | Kastanek et al. | |
| 7,926,295 | B2 | 4/2011 | Brand | |
| 8,100,320 | B2 | 1/2012 | Brand | |

(Continued)

*Primary Examiner* — Christopher Demeree

(74) *Attorney, Agent, or Firm* — Wood Herron & Evans LLP

(57) ABSTRACT

A carton for holding containers can be converted from a first configuration for storing and shipping the containers therein to a second configuration in which the carton forms an open-top cooler for chilling and serving the containers. A beverage container cooling carton is dimensioned for increased ice surface contact with the outer surfaces of a number of the beverage containers such that heat transfer between the ice and beverage containers occurs efficiently.

25 Claims, 15 Drawing Sheets

(56) References Cited

U.S. PATENT DOCUMENTS

| | | | | |
|---|---|---|---|---|
| 8,109,433 | B2 * | 2/2012 | De Paula | B65D 71/34<br>229/101 |
| 8,136,717 | B2 | 3/2012 | De Paula et al. | |
| 8,191,761 | B2 | 6/2012 | Brand | |
| 8,479,525 | B2 | 7/2013 | Brand | |
| 8,556,160 | B2 | 10/2013 | Spivey, Sr. | |
| 8,752,755 | B2 | 6/2014 | De Paula et al. | |
| 8,911,339 | B2 | 12/2014 | De Paula et al. | |
| 8,978,963 | B2 | 3/2015 | Kastanek et al. | |
| 2013/0186045 | A1 * | 7/2013 | Kastanek | B65D 5/4208<br>53/492 |

* cited by examiner

EXPANDABLE BEVERAGE CONTAINER CARTON ADAPTED TO RECEIVE ICE THEREIN

This claims the benefit of U.S. Provisional Patent Application Ser. No. 62/259,694, filed Nov. 25, 2015 and hereby incorporated by reference in its entirety.

BACKGROUND OF THE INVENTION

This invention relates to a carton and a blank for forming the carton for containing a number of articles, and in particular, to a carton, the capacity of which can be increased to accommodate additional items and provide access to the articles in the carton.

Cartons for encasing multiple articles are useful for enabling consumers to obtain and transport a desired quantity of individual articles such as soft drinks or other beverages.

It is often desirable to serve a large quantity of containers, such as beverage and foodstuff containers, in a chilled condition. It may be desirable or necessary to chill such containers at locations or events for which there is little or no access to refrigerators or freezers, or at events for which it is not desirable to use refrigerators or freezers. For example, a large quantity of beverage and foodstuff containers may be served at parties, cookouts, picnics or vacation spots where it is desired to chill the containers for an extended period of time. In such cases, it is customary to place the containers in a cooler containing ice, which often requires the containers to be removed from their original packaging. In some cases, it would be advantageous to be able to chill containers in their original packaging without having to provide a separate cooler. Such cartons need to be strong enough to support multiple articles. It is also desirable for such cartons to be easy to handle and portable. It is also useful for the consumer to be able to add ice-cubes into such a carton to cool the beverage cans or bottles contained within the carton. It is also often desirable for the cartons to be adaptable so that the capacity of the carton can be increased to accommodate the addition of ice-cubes.

Such cartons are known in the art, but each has certain drawbacks. Many such cartons do not provide a means for increasing the capacity of the carton to accommodate the addition of ice cubes and so the carton is limited in the number of ice cubes which it can receive and the degree to which the containers in the carton are adequately chilled.

A carton having additional side and end panels which can be unfolded to provide additional capacity to the carton is known, but many such cartons require a considerable quantity of material to form the carton.

The prior art devices suffer from several drawbacks. The prior art devices do not allow incorporation of refrigeration elements into a standard paperboard beverage carton. Moreover, the prior art devices fail to effectively maximize the contact areas between the beverage containers and chilling elements, which enhances the cooling function provided by such chilling elements. These and other drawbacks of the prior art are overcome by this invention.

In view of the above, it is desirable to provide a carton that is convertible from a first configuration for holding containers during storage and/or transport to a second configuration in which the carton forms a cooler configured to receive ice for chilling and serving the containers while minimizing the amount of material required to form the carton.

SUMMARY OF THE INVENTION

One aspect of this invention is a carton for holding a number of containers. In one example, the carton has a number of panels extending at least partially around an interior of the carton. The panels can include a bottom panel, a first side panel foldably connected to the bottom panel, a top panel foldably connected to the first side panel, a second side panel foldably connected to the bottom panel, and an expansion mechanism. Opposite ends of the side panels may be respectively foldably connected to gusset folds that are mounted to end flaps extending from the bottom panel. An access feature for providing access to the interior of the carton (e.g., a dispenser) may extend in at least the top panel.

The bottom panel, first and second side panels and a top panel may together extend at least partially around an interior of the carton. The gusset folds, optionally in conjunction with expansion panels, may provide expandable connections between the top panel and the side panels. The expandable connections may be spaced apart from one another, and the expandable connections may be expandable so that the side panels are moved outwardly relative to the top panel, from an inner configuration to an outer configuration, to at least partially define an upwardly open space for being open to the interior by way of the dispenser.

Each of the gusset folds may include one or more pleats. In one specific example, each expandable connection includes a gusset flap connected to one of the panels, an intermediate flap and a gusset flap connected to the bottom end flap.

The foregoing presents a simplified summary of some aspects of this invention to provide a basic understanding. The foregoing summary is not extensive and is not intended to identify key or critical elements of the invention or to delineate the scope of the invention. The purpose of the foregoing summary is to present some concepts of this disclosure in a simplified form as a prelude to the more detailed description that is presented later and other aspects will become apparent from the following.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
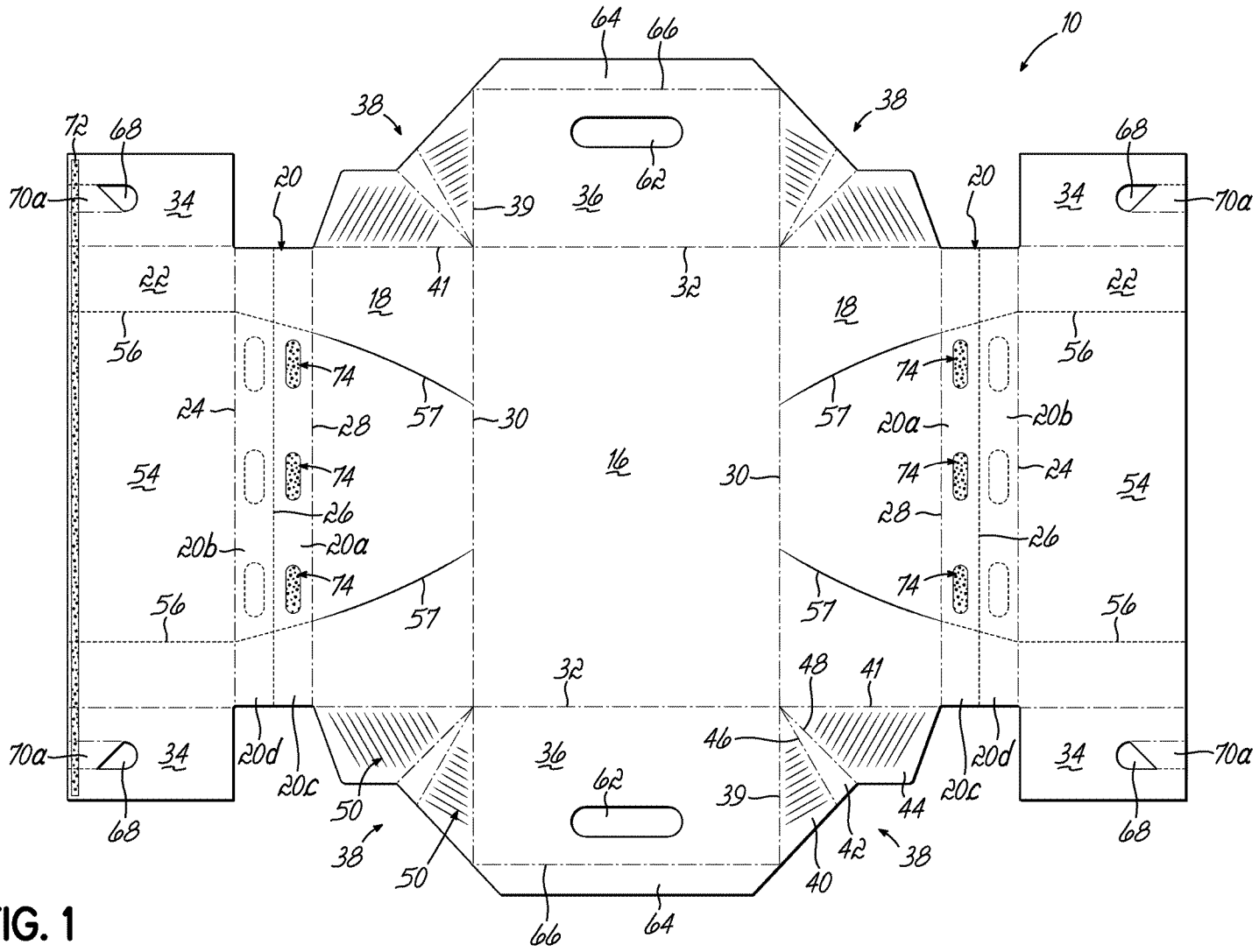
FIG. 1 is a top plan view of a blank used to form a carton according to a first embodiment of this invention.

Exemplary embodiments of this invention are described below and shown in the accompanying drawings, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of this invention.

This invention generally relates to opening, dispensing, and cooling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to this invention can accommodate articles of any shape. For the purpose of illustration and not for the purpose of limiting the scope of the invention, the following detailed description describes beverage containers (e.g., aluminum beverage cans) as disposed within the carton embodiments.

The carton can be used to house a number of articles such as containers C (shown by way of example in FIGS. 6, 7, 10, 11 and 13-15). In the embodiments shown in the drawings, the containers C are generally-cylindrical cans, and the carton is sized to house twenty-four containers C in a single layer in a 4×6 arrangement. However, the carton may be sized and shaped to hold containers C of a different or same quantity in more than one layer and/or in different row/column arrangements (e.g., 3×8, 3×6, 2×6, 2×6×2, 3×4, 2×9, 4×3×2, etc.). The containers C could be otherwise shaped, arranged, and/or configured without departing from the invention. For example, the containers C could be beverage bottles or other containers.

Figure 8:
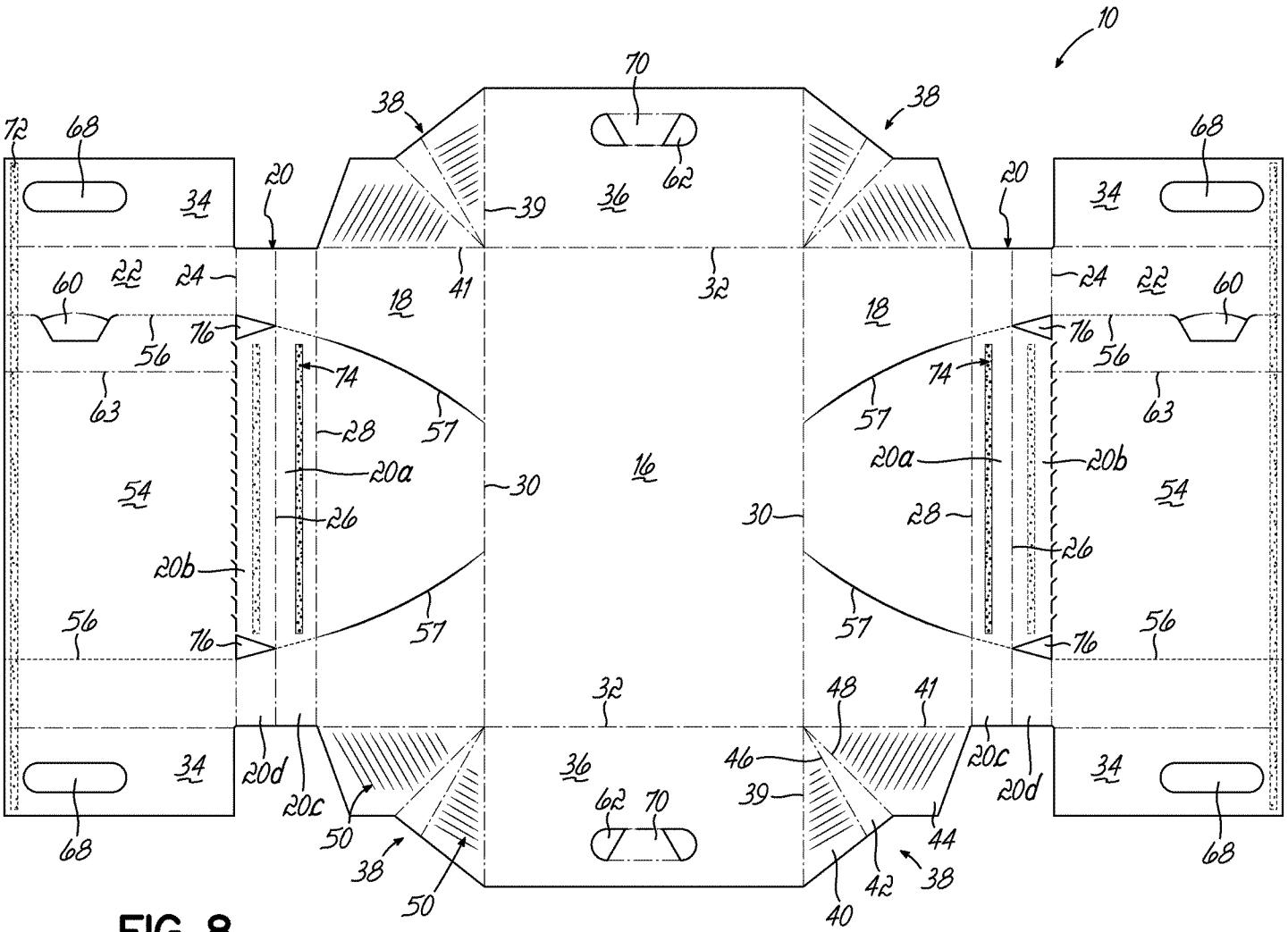
FIG. 8 is a top plan view of a second embodiment of a blank used to form a carton according to this invention.
Figure 12:
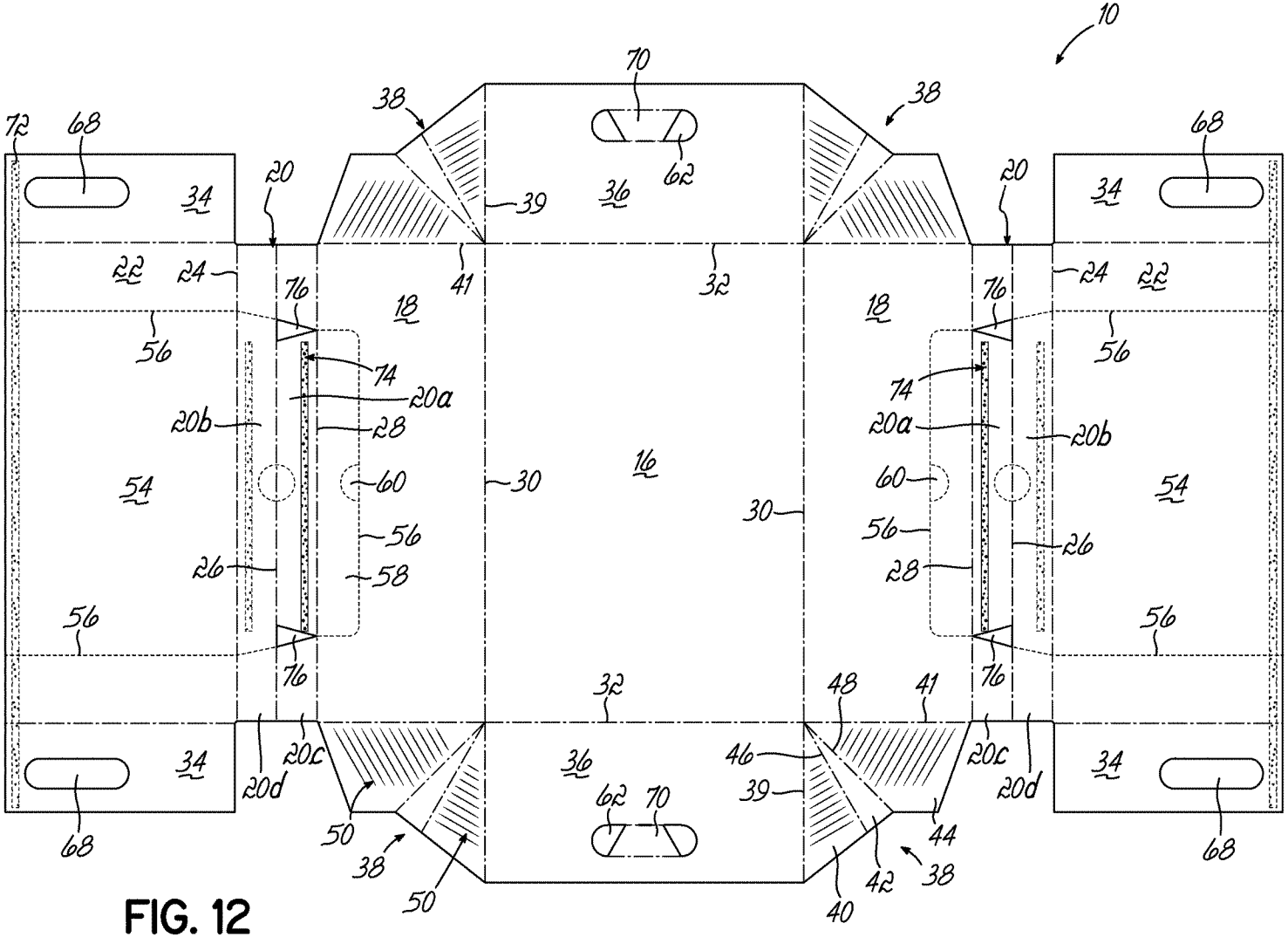
FIG. 12 is a top plan view of a third embodiment of a blank used to form a carton according to this invention.

Referring to FIGS. 1, 8 and 12 in which first, second and third embodiments, respectively, of a carton blank 10 according to this invention are shown. The carton blanks 10 are used to form a carton 12 as shown in subsequent drawings and intended to contain a number of beverage containers C. Moreover, the carton 12 formed from the carton blank 10 according to various embodiments of this invention may be transformed from a first storage and travel configuration to an expanded configuration into which ice 14 or another medium for chilling the beverage containers C within the carton 12 may be added.

The carton blanks 10 of FIGS. 1, 8 and 12 each include a print side as shown in FIGS. 1, 8 and 12 and an opposite non-print side. The carton blanks 10 each include a central bottom panel 16 bordered on either side by one of two side panels 18. Each side panel 18 has a pair of expansion panels 20*a*, 20*b* joined thereto opposite from the bottom panel 16. A top panel 22 is joined to the expansion panels 20. A number of transverse fold lines 24, 26, 28, 30 extend generally parallel with one another between the top, expansion, side and bottom panels of the carton blanks 10. Each carton blank 10 also includes a pair of longitudinal fold lines 32 extending generally perpendicular to the transverse fold lines. Extending outwardly from one of the longitudinal fold lines are top panel flaps 34 and bottom panel flaps 36 connected to the respective top and bottom panels 22, 16.

In various embodiments of the carton blank 10 according to this invention, the carton blank 10 is symmetric about both a longitudinal and a lateral line bisecting the carton blank 10 in those directions.

A gusset fold 38 joins a lateral side edge of each bottom panel flap 36 to the adjacent side panel 18 via fold lines 39, 41. Each gusset fold 38 according to various embodiments of this invention includes three gusset flaps 40, 42, 44 each separated by gusset fold lines 46, 48 as shown in FIGS. 1, 8 and 12. Two of the gusset flaps 40, 44 include a series of parallel score lines 50 to assist in the folding operation of the gusset fold 38. The score lines 50 on the gusset flaps 40, 44 stiffen the gusset flaps 40, 44 thereby minimizing bowing between the folding gusset fold lines 46, 48.

The cartons 12 erected from the respective carton blanks 10 of FIGS. 1, 8 and 12 each include a dispenser 52 formed by a dispenser panel 54 which is located at least in part in each top panel 22 of the carton blank 10. The dispenser panel 54 is defined in part by a dispenser tear line 56. The portions of the dispenser tear line 56 in each top panel 22 extend generally parallel to one another and parallel to the longitudinal fold lines 32 of the carton blank 10 while other portions of the tear line 56 intersects at least some of the transverse fold lines 24, 26, 28 (FIG. 1). The dispenser tear line 56 also extends into and through the expansion panels 20*a*, 20*b* in the carton blank 10 of FIG. 1. The dispenser tear line 56 extends along the transverse fold line 24 between the extension panels 20*a*, 20*b* and the associated top panel 22 in the carton blank 10 of FIG. 8. The dispenser tear line 56 of the dispenser 52 in the carton blank 10 of FIG. 12 extends through the expansion panels 20 and into the adjacent side panel 18 to thereby form a dispenser flap 58. A dispenser finger flap 60 is provided along the dispenser panel tear line 56 in the top panel 22 of the embodiment of the blank 10 of FIG. 8. A fold line 63 may be included in the dispenser panel 54 spaced from the finger flap 60 to allow for leverage when grasping the dispenser panel 54 at the finger flap 60 and tearing the dispenser tear line 56. The dispenser finger flap 60 is provided along the dispenser tear line 56 in one or both of the side panels 18 of the embodiment shown in FIG. 12. Curved score lines 57 are provided in the side panels 18 of the embodiments in FIGS. 1-11 to relieve stresses in the side panels 18 when the carton 12 is in an expanded configuration as discussed herein below.

Handles 61 are provided on each end of the carton 12. A handle aperture 62 is formed in each of the bottom panel end flaps 36 of the carton blanks 10 of FIGS. 1, 8 and 12. A bottom panel extension flap 64 is formed along the distal end of each bottom panel 36 of the carton blank 10 of FIG. 1 and is joined to the bottom panel flap 36 by an extension panel fold line 66. Handle apertures 68 are also provided on the top panel end flaps 34. A flap 70 is formed within the handle aperture 62 of the bottom panel flaps 36 of the carton blanks 10 of FIGS. 8 and 12 and is intended to keep the beverage containers C from catching on the handle apertures 62 when the beverage containers C are loaded into the carton 12. The flap 70 may be joined to the surrounding carton blank 10 by a fold line along the edge adjacent to the longitudinal fold lines 32 and a tear line or series of nicks adjacent a free edge of the flap 34 or 36 so that the flap may be folded inwardly when the handle 61 is in use (see FIG. 5).

In the embodiment of the carton blank 10 shown in FIG. 1, partial flaps 70*a* are provided within the handle apertures 68 to prevent tipping of the beverage containers C when they are loaded into the carton 12 formed from the blank 10 similar to the flaps 70 in FIGS. 8 and 12 in the handle apertures 62 of the bottom end flaps 36.

A glue line 72 is provided on one of the top panels 22. When the carton blank 10 is folded about the various transverse fold lines 24, 26, 28, 30, the top panels 22 overlap each other and are adhered together by the glue line 72 to form a unitary top panel from the multiple top panels 22 of the blank 10.

The pairs of expansion panels 20*a*, 20*b* are likewise adhered together by one or more glue deposits 74 provided on the print side of one of the expansion panels 20 of each pair of expansion panels. The glue deposit 74 is a single line of glue on the carton blanks 10 of FIGS. 8 and 12 and is provided in three discrete ovals 74 in the carton blank 10 of FIG. 1. The glue deposit 74 is limited to the portion of the expansion panels 20 between the dispenser tear lines 56 as shown in FIGS. 1, 8 and 12.

The carton blanks 10 of FIGS. 8 and 12 also include triangular punch-outs or openings 76 at the intersection of the expansion panel fold lines 24, 26 and the dispenser tear line 56.

Figure 2B:
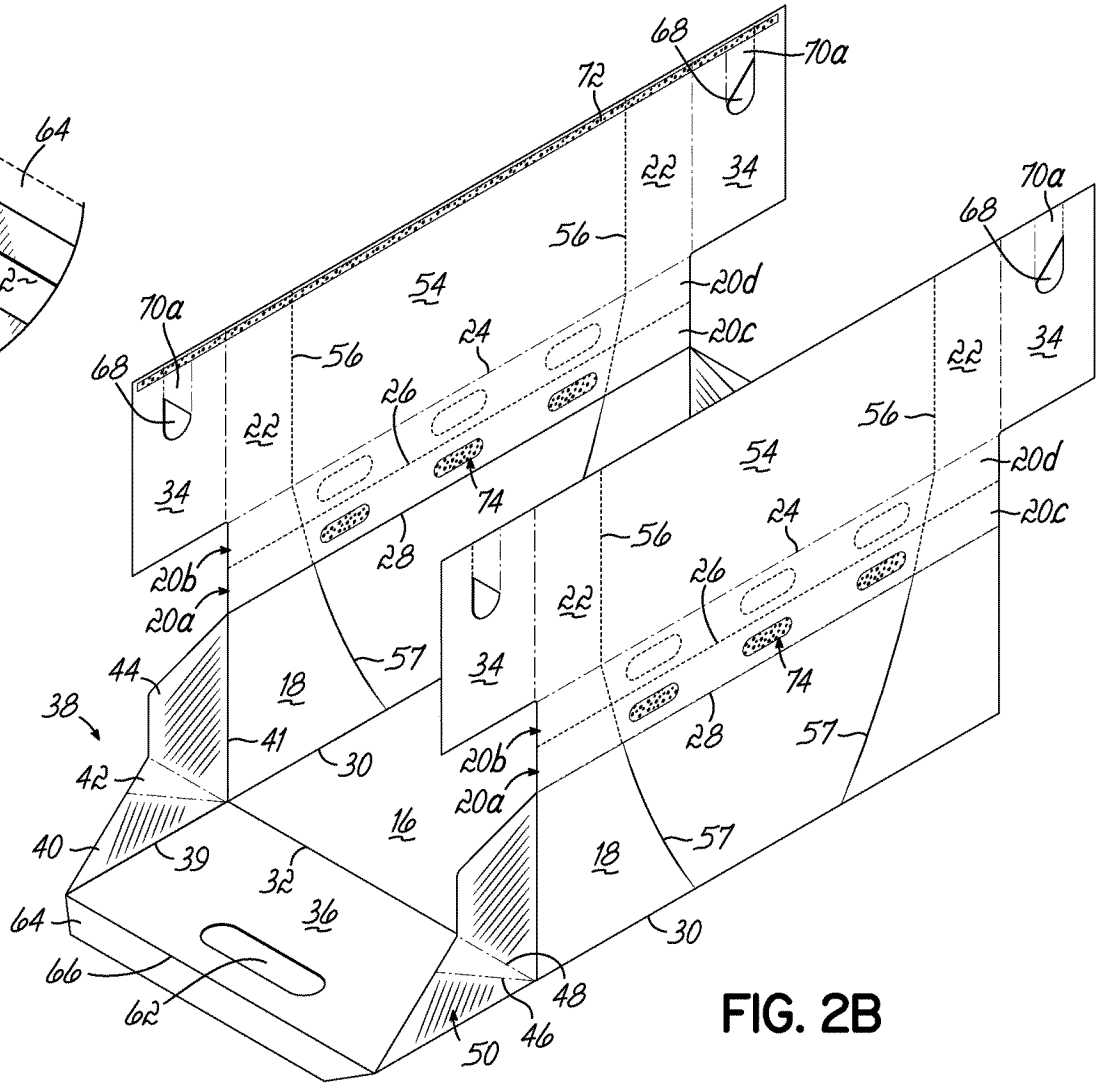
FIG. 2B is a view of the blank of FIG. 1 being folded and erected into the carton.
Figure 2A:
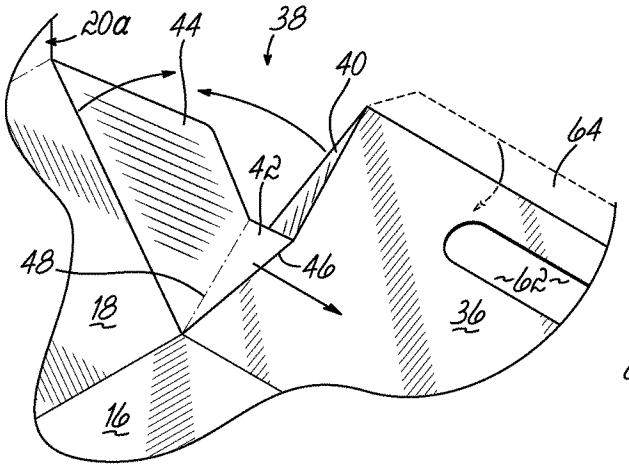
FIG. 2A is an enlarged view of the gusset flaps joining a side panel to a bottom panel end flap being folded to erect a carton from the blank of FIG. 1.
Figure 3B:
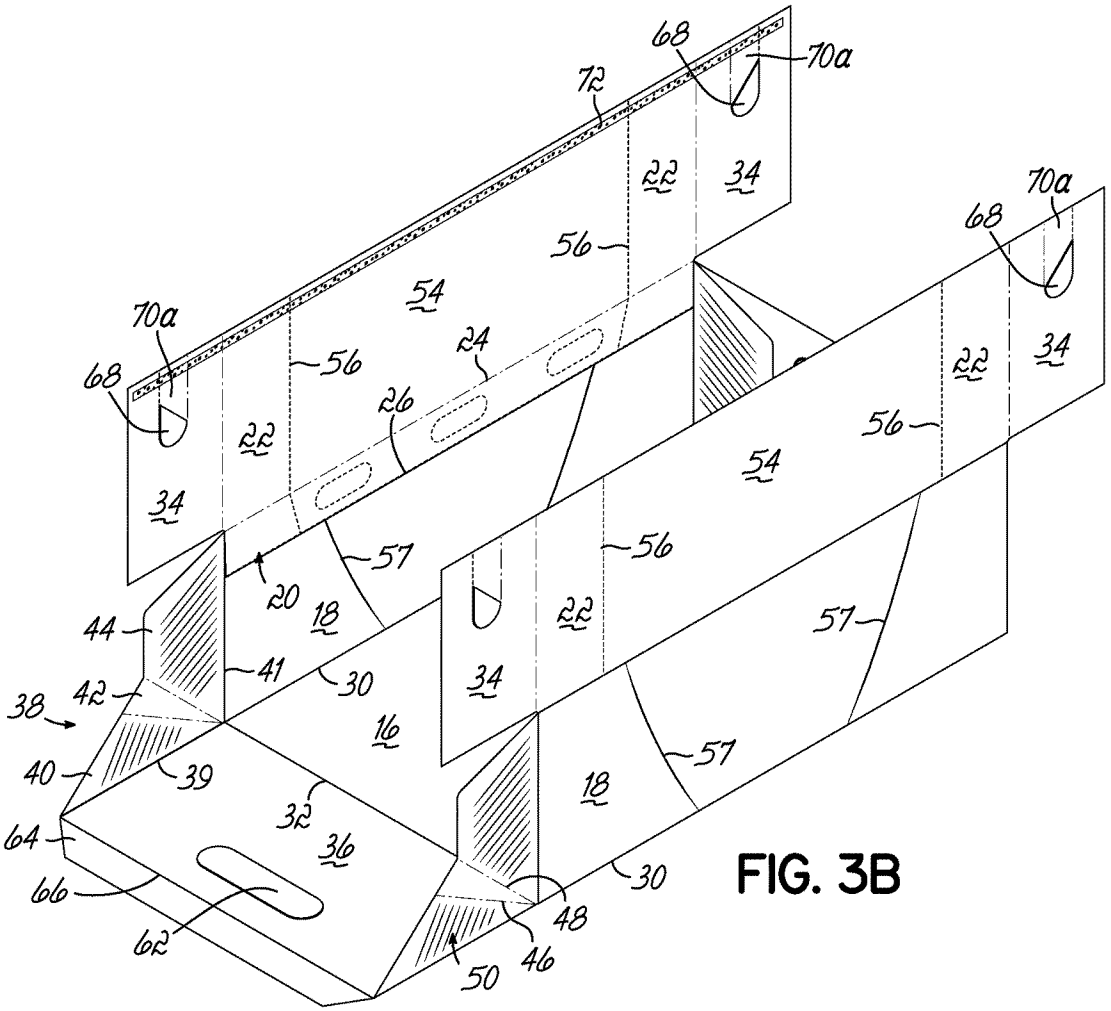
FIG. 3B is a view similar to FIG. 2B with the expansion panels folded as shown in FIG. 3A.
Figure 3A:
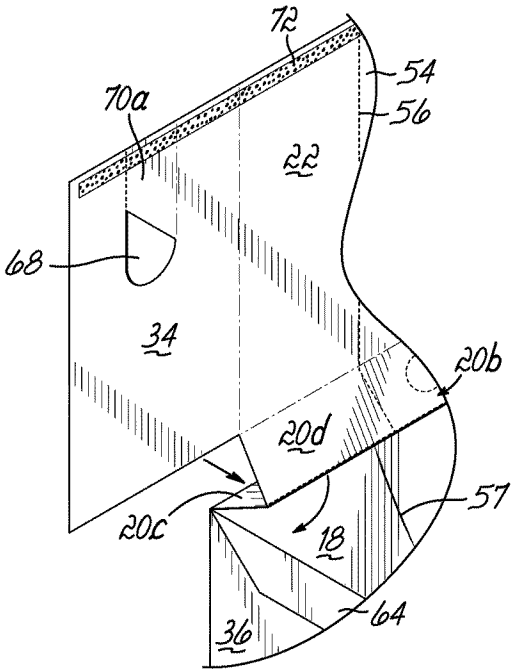
FIG. 3A is an enlarged view of expansion panels connecting a top panel flap to a side panel of the carton blank of FIG. 1.
Figure 4B:
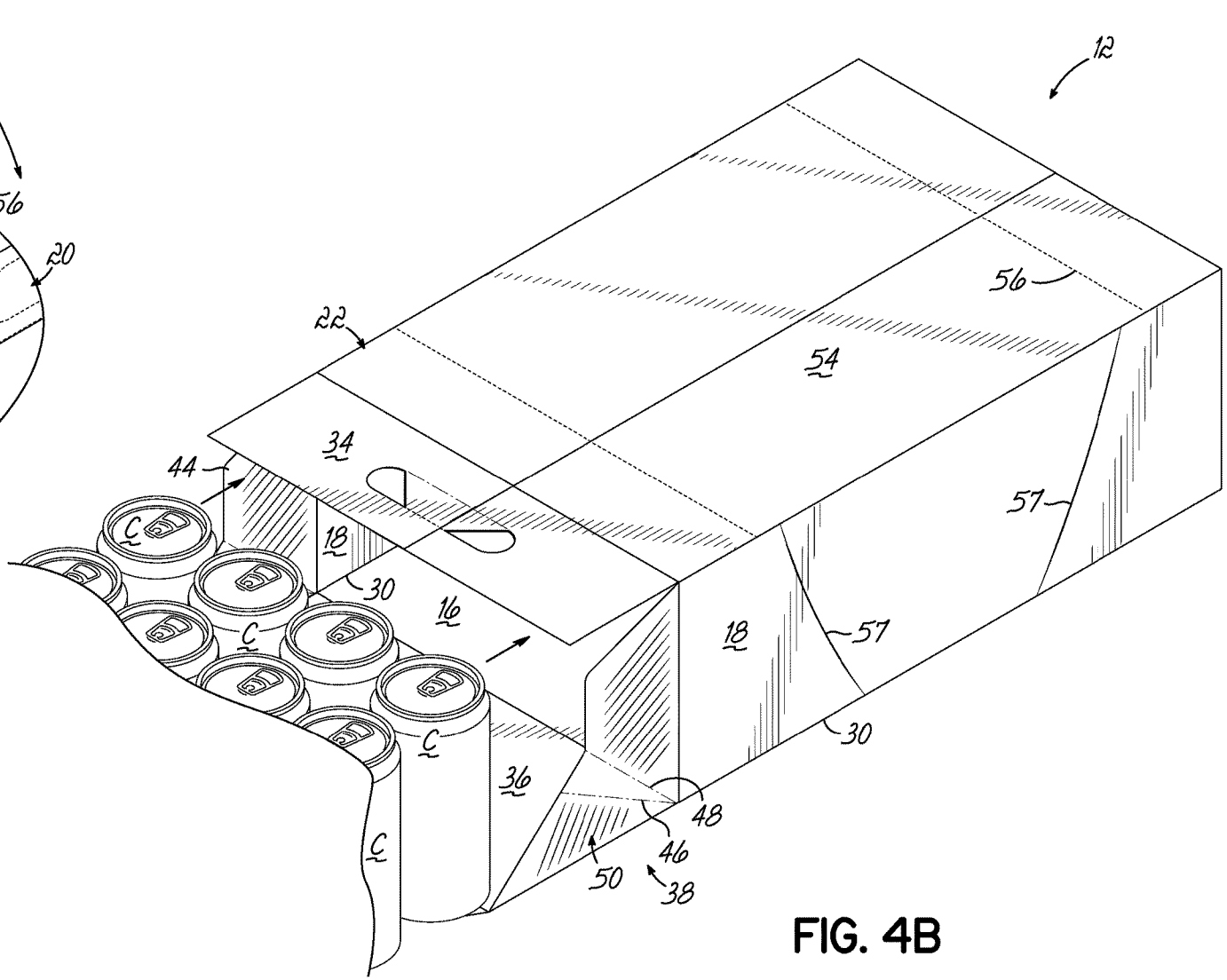
FIG. 4B is a view of the carton formed from the blank of FIG. 1 with beverage containers being inserted into an open end of the carton.
Figure 4A:
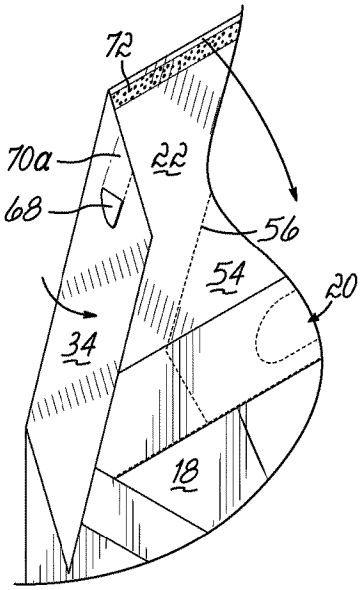
FIG. 4A is an enlarged view of one of the top panels being folded inwardly to form the carton blank into a tubular configuration.
Figure 5:
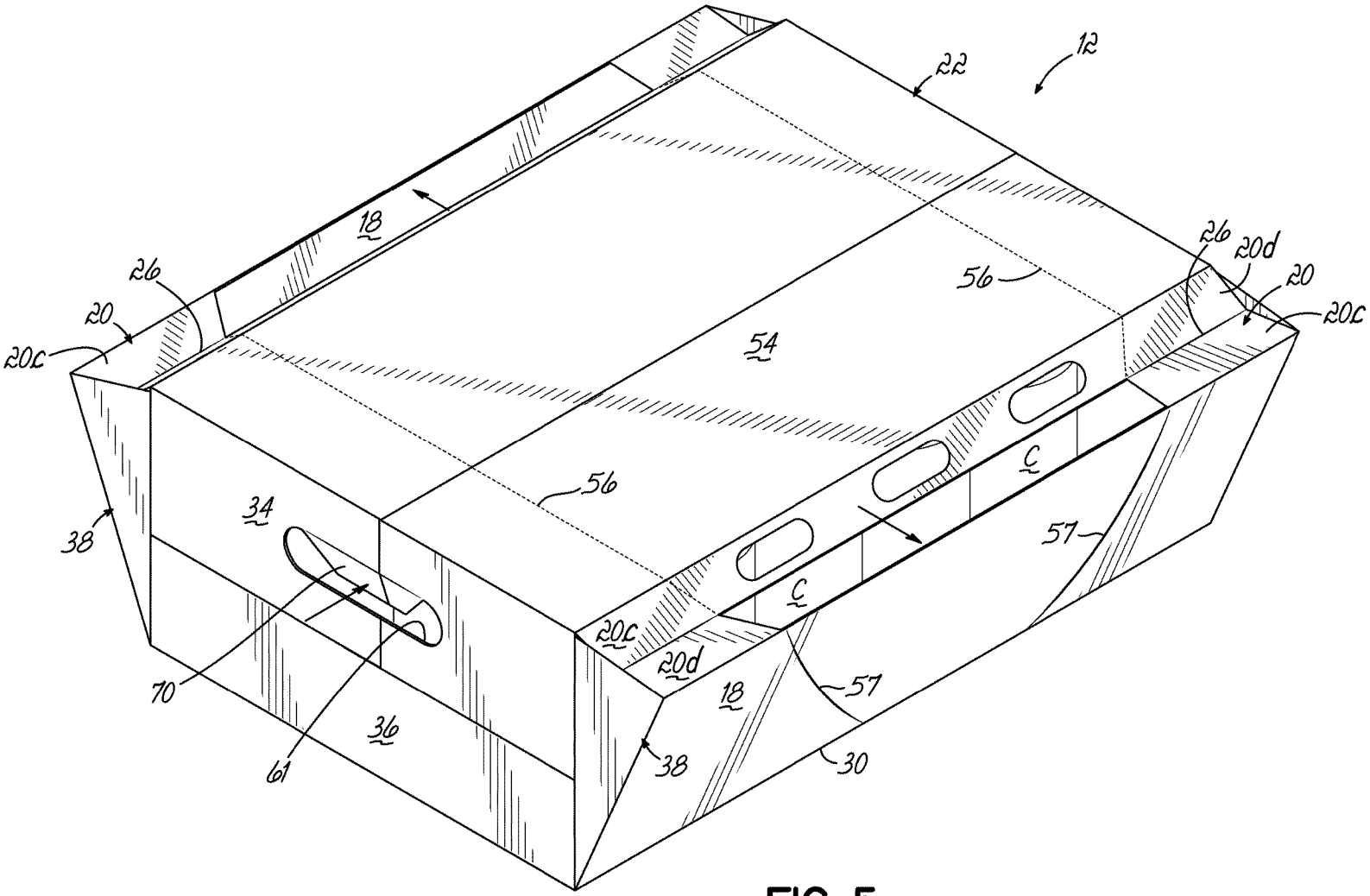
FIG. 5 is a perspective view of the carton of FIG. 4B being expanded into an expanded configuration by expanding the expansion panels along each side of the carton.

The carton blanks 10 of FIGS. 1, 8 and 12 each may be folded into cartons 12 for containing a number of beverage containers C forming a package according to various aspects of this invention. The carton blanks 10 are initially folded about their respective transverse fold lines 24, 26, 28, 30 to form a generally tubular configuration with the top panels 22 at the opposite longitudinal ends of the blanks 10 overlapping and being glued to one another via glue line 72 to combine to form a top panel of the carton 12. Either of the bottom panel flaps 36 may be folded upwardly to form an end of the carton 12 or the carton blank 10 may be formed into a generally open tubular configuration for the beverage containers C to be inserted into the tube after which one or both of the ends of the cartons 12 may be erected. The insertion of the beverage containers C into the tubular configuration is shown generally in FIG. 4B. The gusset folds 38 joining the bottom panel end flaps 36 to the respective side panels 18 are folded as generally shown in FIG. 2A with the center generally triangular shaped gusset flap 42 folded inwardly toward the interior of the carton 12 and the bottom panel end flap 36 folded upwardly about the adjacent longitudinal fold line 32 to be generally perpendicular to the bottom panel 16 and the adjacent side panels 18.

Another aspect of erecting the respective cartons 12 from the associated carton blanks 10 is the expansion panels 20 positioned between the side panel 18 and associated top panel 22. As shown generally in FIG. 3A, the expansion panels 20*a*, 20*b* are folded inwardly into a generally face-to-face juxtaposition with the print side of each expansion panel 20 adhered to the print side of the associated expansion panel 20 by the glue deposit 74. As previously noted, the glue deposit 74 does not extend to the outer ends 20*c*, 20*d* of the expansion panels 20, but is contained between the dispenser tear lines 56 extending into the expansion panels 20.

Figure 7:
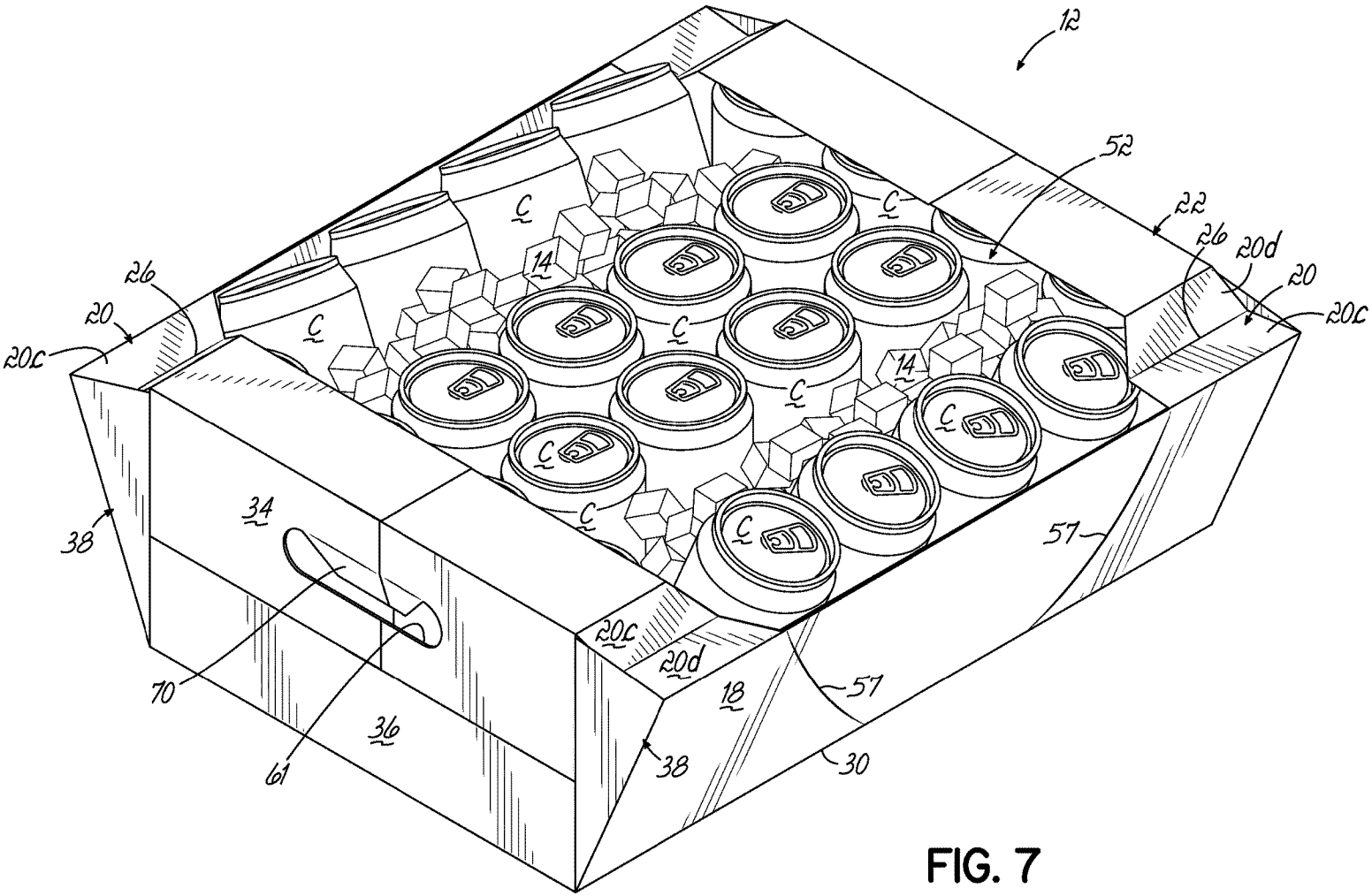
FIG. 7 is a view of the carton of FIG. 6 with the dispenser panel removed and ice added to the carton for chilling the beverage containers therein.
Figure 9:
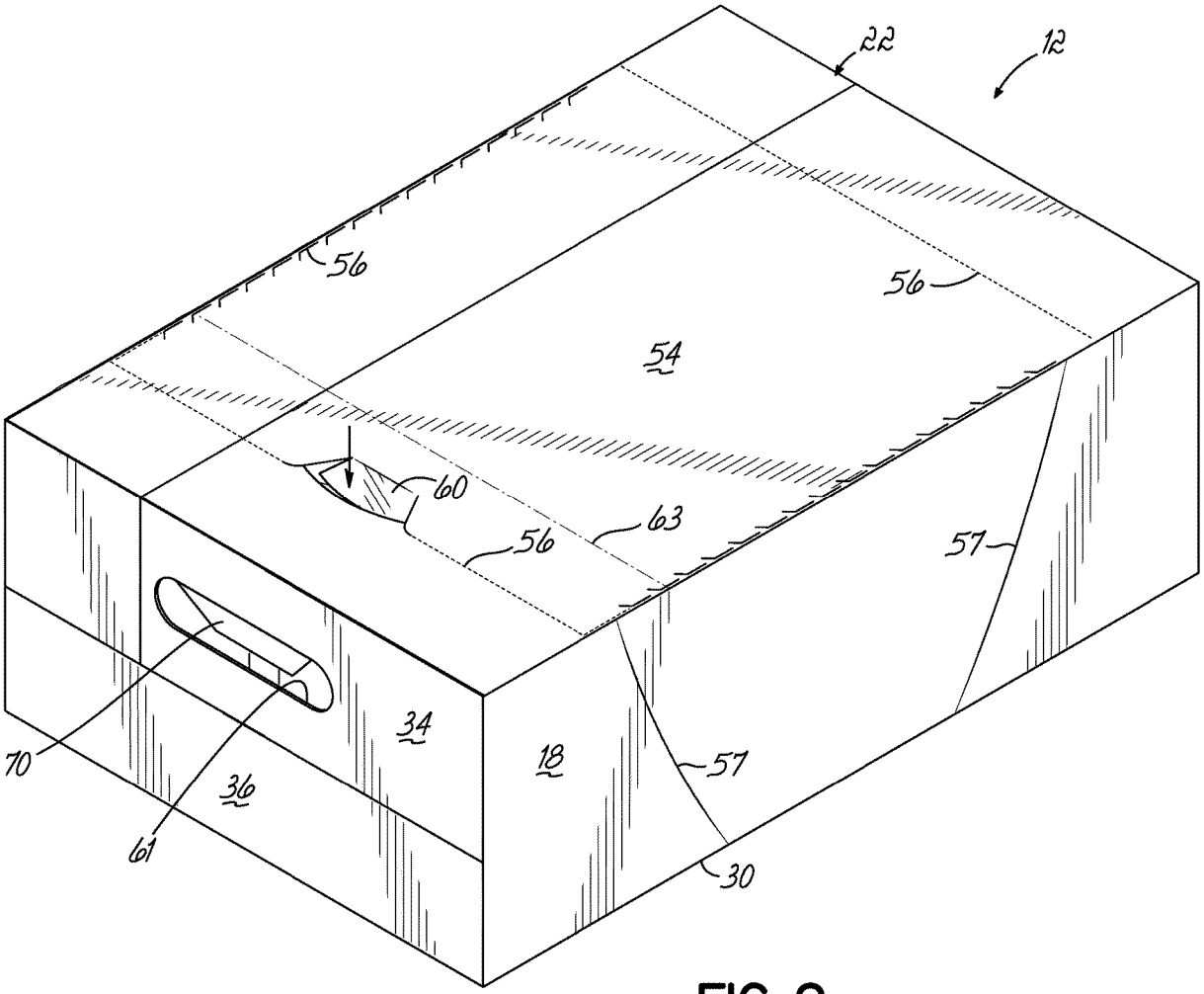
FIG. 9 is a perspective view of a carton erected from the carton blank of FIG. 8 with a dispenser finger flap being depressed to initiate removal of a dispenser panel.
Figure 11:
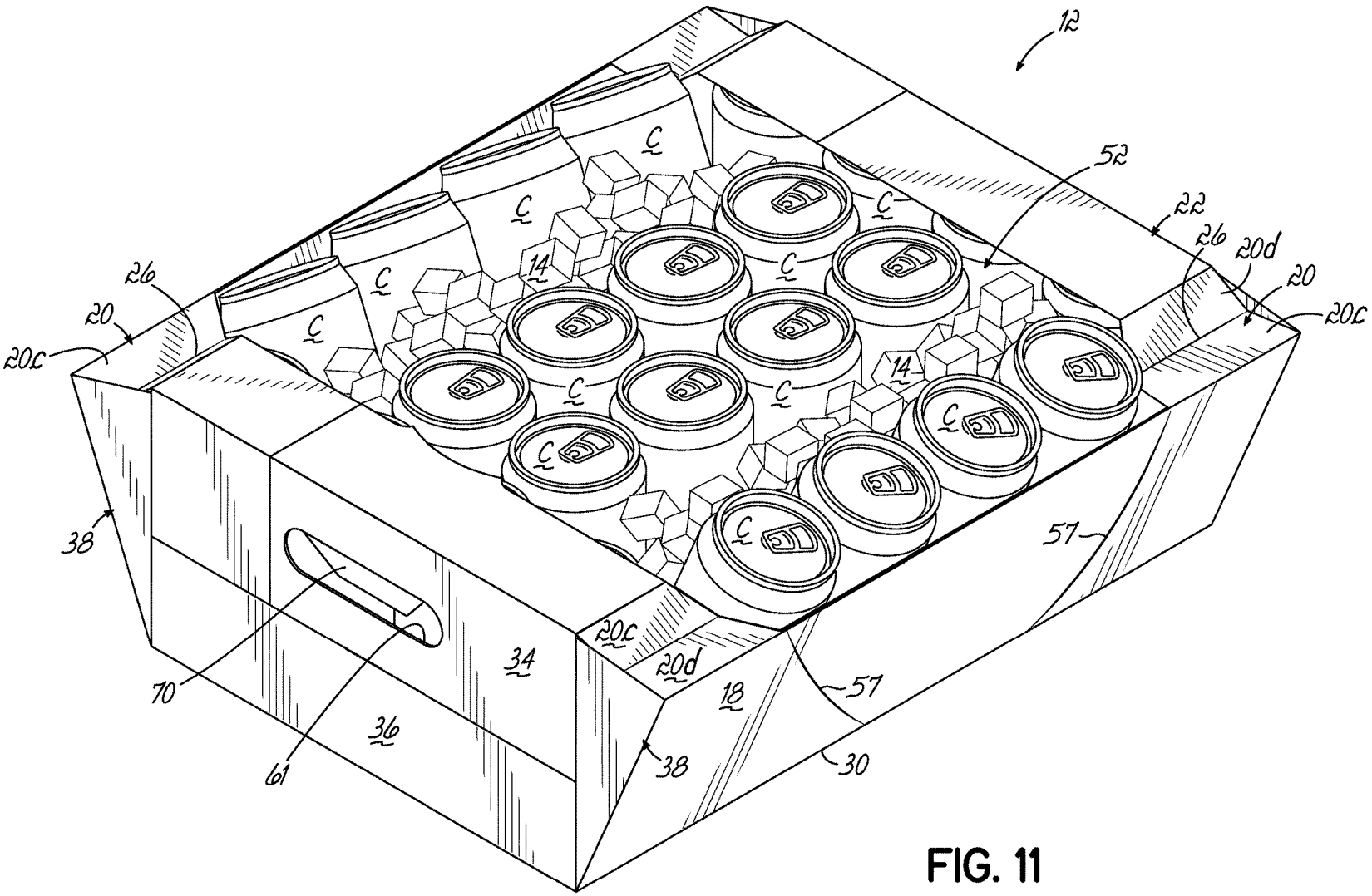
FIG. 11 is a perspective view of the carton of FIG. 10 in an expanded configuration with ice added to the carton for chilling the beverage containers therein.
Figure 13:
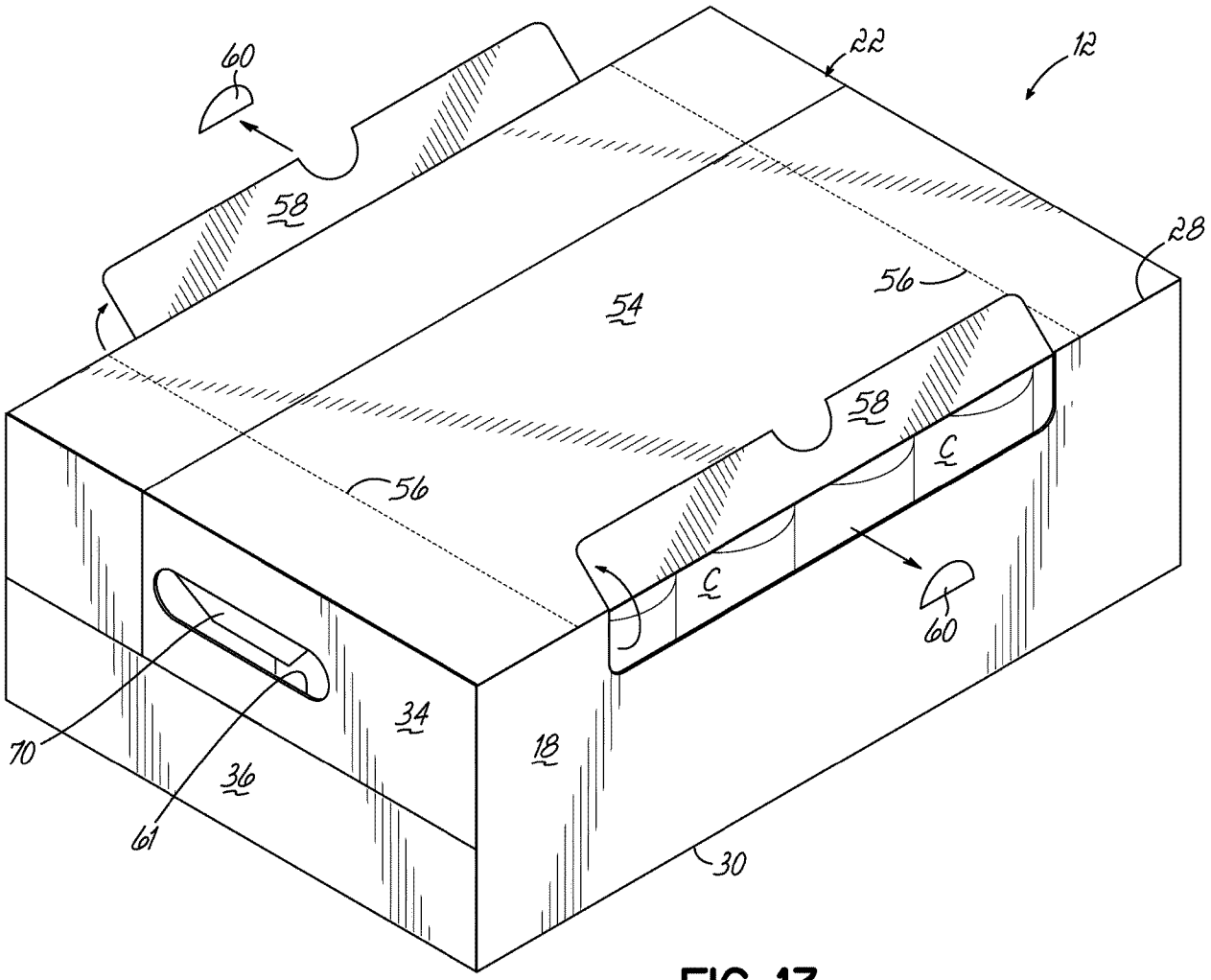
FIG. 13 is a perspective view of a carton erected and filled utilizing the carton blank of FIG. 12 with the dispenser flaps being torn from the carton.
Figure 15:
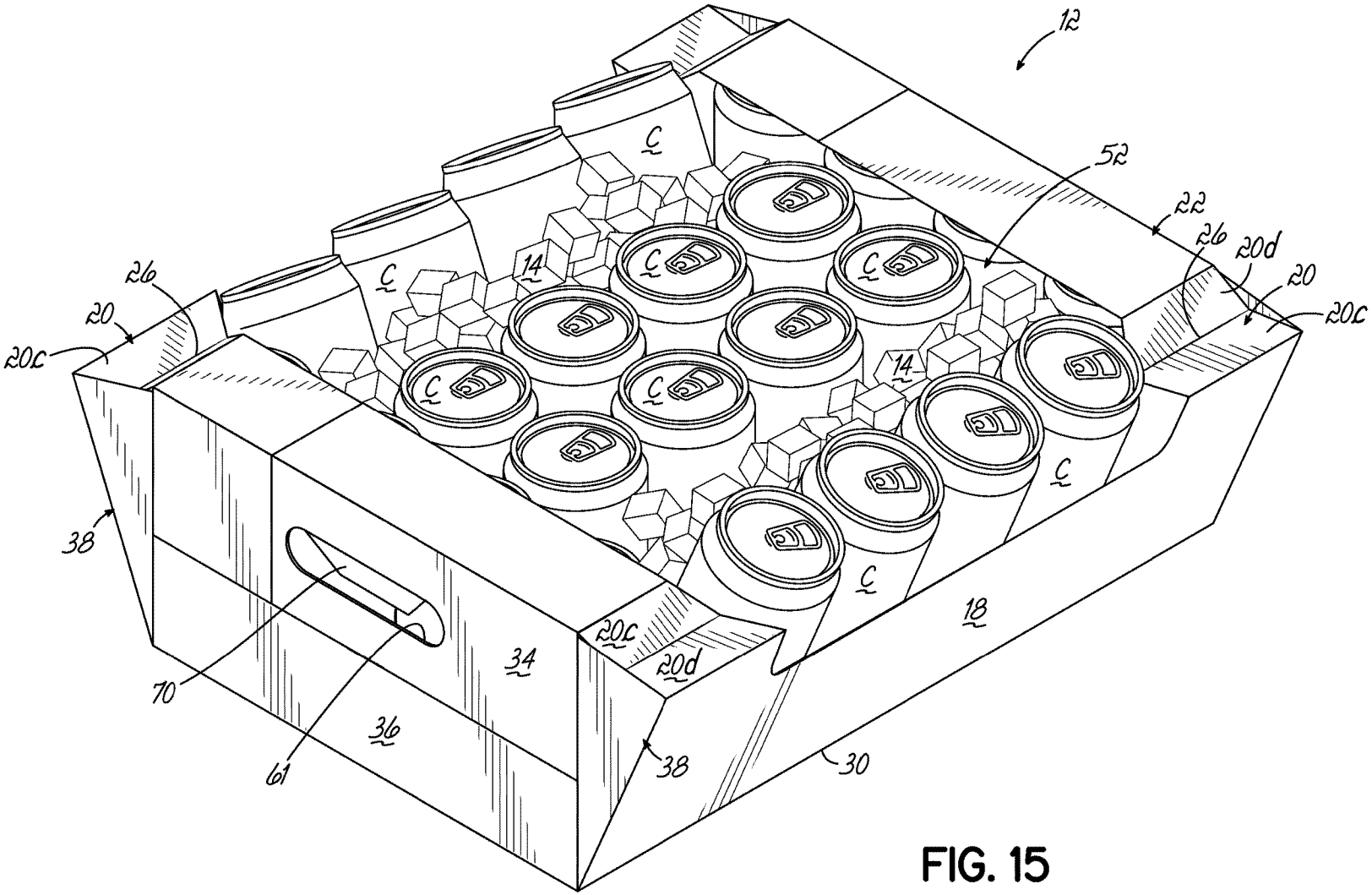
FIG. 15 is a view of the carton of FIGS. 13 and 14 in an expanded configuration with ice added to the carton for chilling the beverage containers therein.

Once the carton blank 10 is erected into the carton 12 and filled with the containers C, the ends of the carton 12 are closed and sealed to thereby form a package including a carton 12 filled with containers C as shown generally in FIGS. 9 and 13. The erected and filled carton 12 forming the package is presented in a first configuration in which the expansion panels 20 are adhered together and the carton 12 forms a generally parallelepiped construction. The package is then suitable for storage, shipping, transport and display. Once the user is ready for accessing and chilling the beverage containers C within the carton 12, the carton 12 may be expanded to a second, expanded configuration as generally shown in FIGS. 7, 11 and 15. Removal of the dispenser panel 54 from the carton 12 allows for the transformation of the carton 12 from the first configuration to the second expanded configuration.

Figure 6:
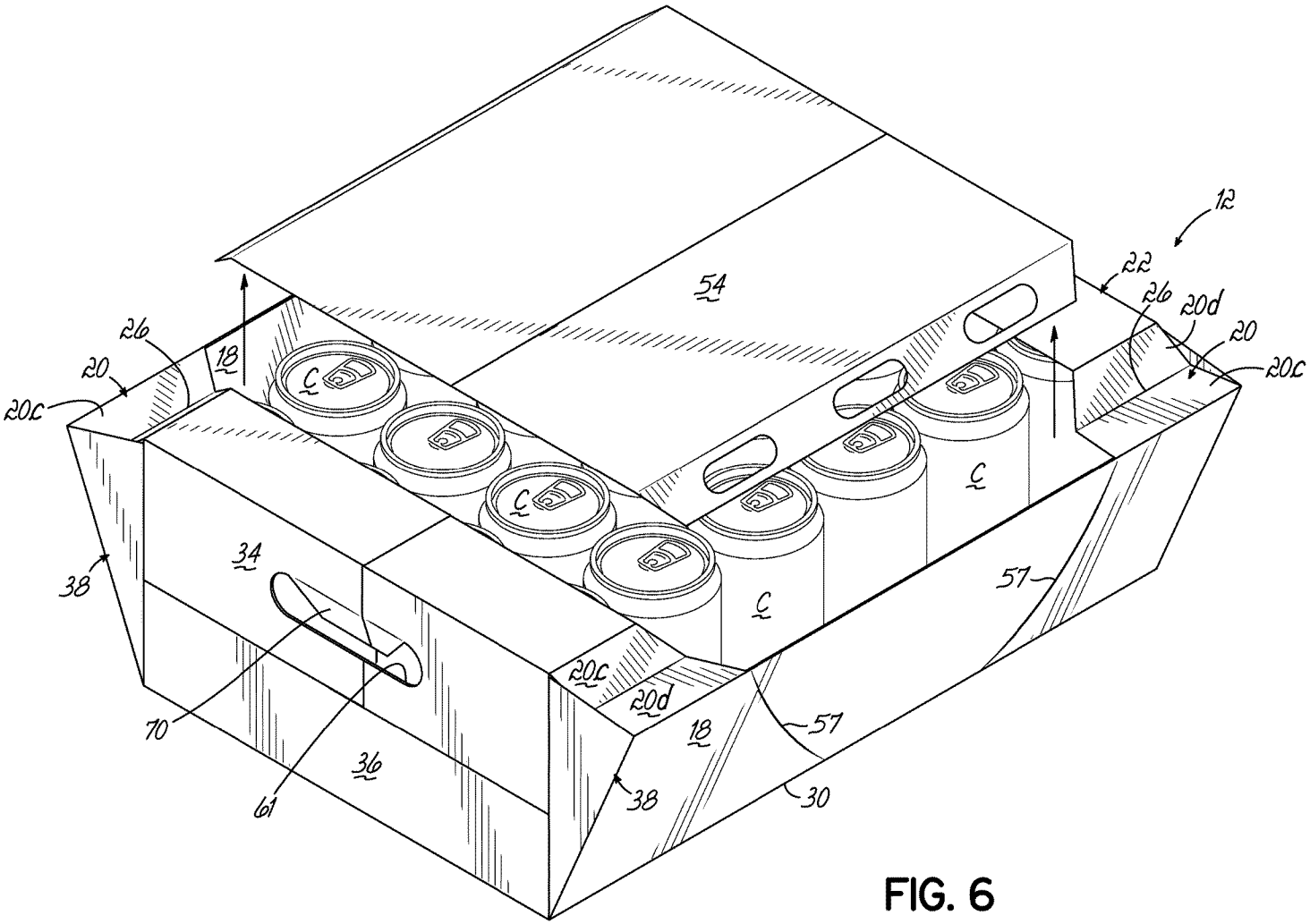
FIG. 6 is a view of the carton of FIG. 5 with a dispenser panel being removed from the carton.

Removal of the dispenser panel 54 from the carton 12 according to one embodiment is shown in FIG. 6. In the embodiment of FIGS. 1-7, the fold line 26 between the expansion panels 20*a*, 20*b* is also a tear line to allow for separation of the dispenser panel 54. As such, the outboard expansion panel 20*b* remains adhered to the adjacent side panel 18 even after the dispenser panel 54 is removed. The glue deposit 74 between the adjacent expansion panels 20*a*, 20*b* is separated when the dispenser panel 54 is removed.

Figure 10:
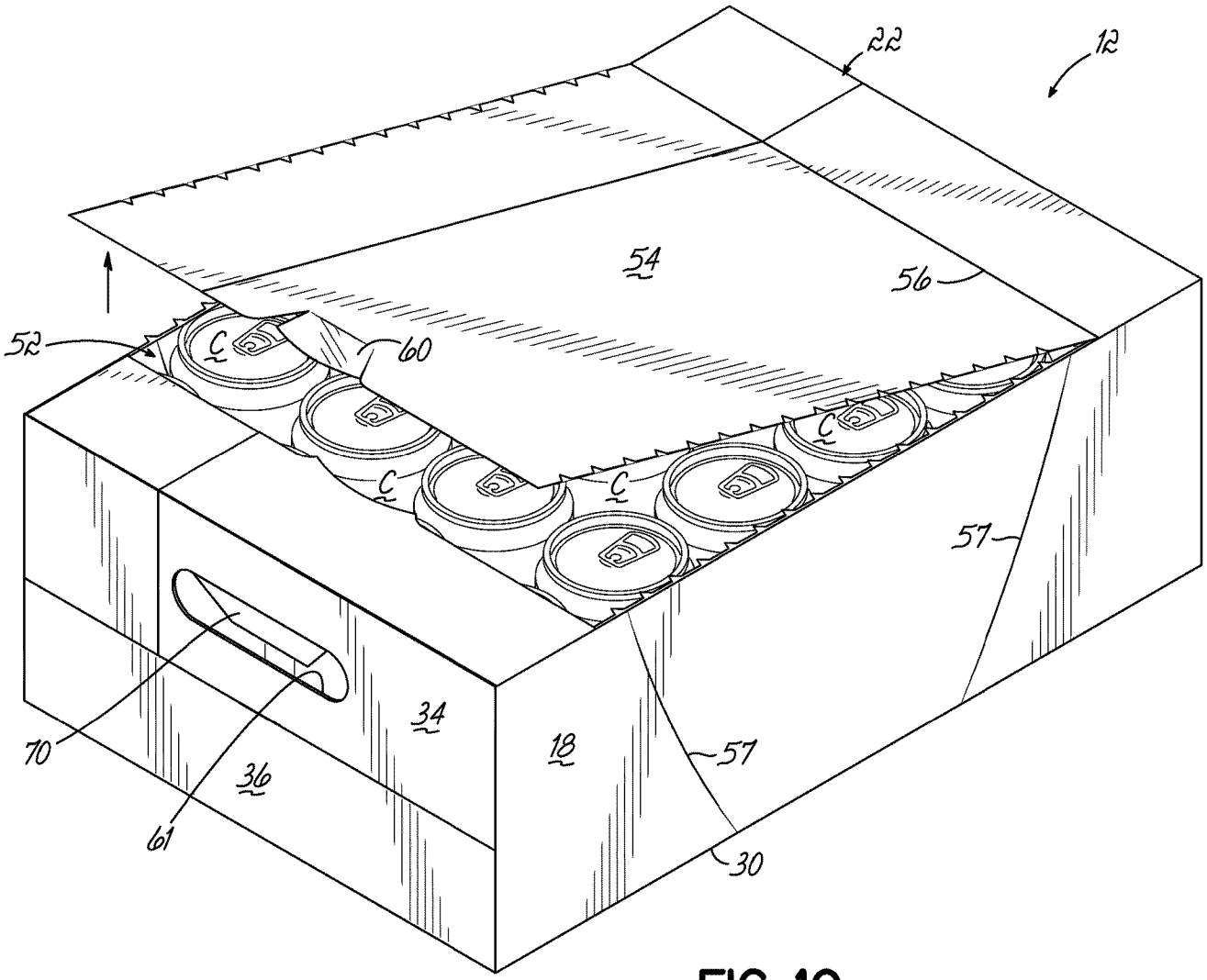
FIG. 10 is a view similar to FIG. 9 with the dispenser panel of the carton being removed from the carton.

Removal of the dispenser panel 54 according to another embodiment is shown in FIGS. 9 and 10 in which the dispenser finger flap 60 in the top panel 22 is initially depressed inwardly allowing the user to grasp the dispenser panel 54 for removal from the carton 12 by tearing along the dispenser tear line 56. The fold line 24 between the top panel 22 and the adjacent expansion panel 20*b* is also a tear line so both expansion panels 20*a*, 20*b* remain attached to the side panel 18 when the dispenser panel 54 is removed.

Figure 14:
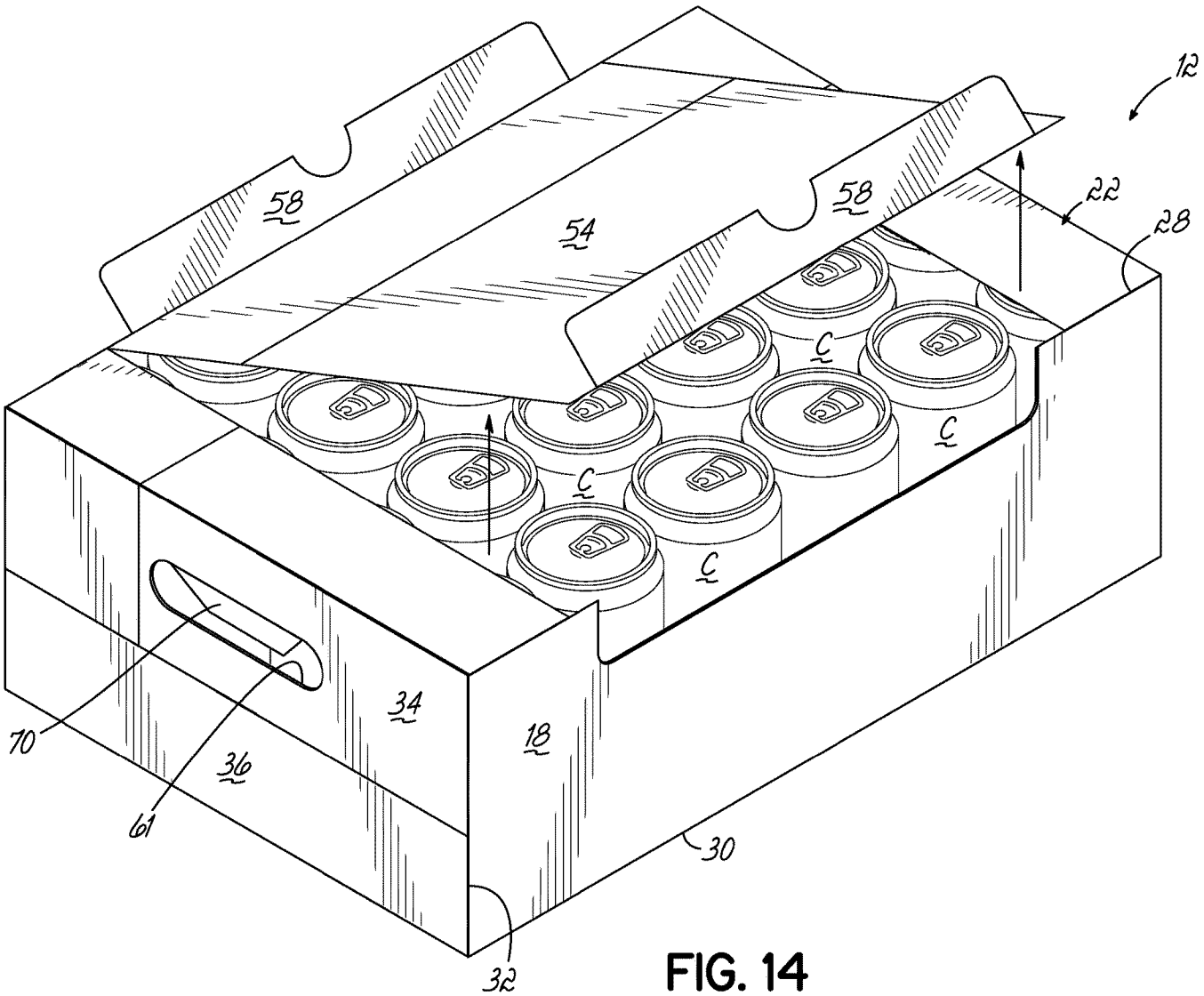
FIG. 14 is a view similar to FIG. 13 with a dispenser panel of the carton being removed to expose the beverage containers therein.

The dispenser panel 54 according to the third embodiment of this invention is removed from the carton 12 as shown in FIGS. 13 and 14 by initially depressing inwardly and removal of the finger flap 60 at one or both sides of the carton 12 as shown in FIG. 13. The dispenser flap 58 can then be pivoted upwardly and grasped by the user to pull the dispenser panel 54 upwardly as shown in FIG. 14 thereby tearing the dispenser panel 54 from the carton 12 along the dispenser tear line 56. Both of the expansion panels 20*a*, 20*b* and the dispenser flap 58 on each side of the dispenser panel 54 are removed from the carton 12 with the dispenser panel in this embodiment.

Removal of the dispenser panel 54 frees the end portions 20*c*, 20*d* of the expansion panels 20 in each embodiment. As such, after the dispenser tear line 56 is torn, the outer ends 20*c*, 20*d* of the expansion panels 20 which are not adhered together expand into the configuration shown in FIGS. 6-7, 11 and 15 thereby allowing the side panels 18 to pivot outwardly about the transverse fold lines 30 bordering the bottom panel 16 of the carton 12. The gusset folds 38 joining the side panels 18 to the end flaps 36 of the carton 12 further allow for the transformation of the carton 12 into the expanded configuration shown in FIGS. 6, 7, 11 and 15. Advantageously, when the carton 12 is expanded to the expanded configuration, the beverage containers C adjacent to the side panels 18 are allowed to tilt or pivot outwardly along with the adjacent side panel 18. Note the position and orientation of the containers C adjacent the side panels 18 in FIGS. 10 and 14 in which these containers C are similarly oriented in an upright position relative to the containers C in the interior rows versus the position and orientation of the containers C adjacent the side panels 18 in FIGS. 11 and 15 in which those containers C are tilted and/or pivoted outwardly when the carton 12 is in the expanded configuration. This provides for added space between the beverage containers C to accommodate ice 14 or another medium to chill the beverage containers C while they remain within the carton 12. Advantageously, each of the beverage containers C has increased exposure when the carton 12 is in the expanded configuration for direct contact with the ice 14 or other chilling medium as generally shown in FIGS. 7, 11 and 15. Moreover, once the beverage containers C are sufficiently chilled, the carton 12 provides convenient and ready access to all of the beverage containers C positioned beneath the dispenser panel 54. Once selected beverage containers C are removed from the carton 12, remaining beverage containers C may be repositioned within the carton 12 for more convenient access and removal as desired.

One aspect of the expandable beverage carton 12 according to various embodiments of this invention is that the entire bottom portion of the carton 12 in the expanded configuration remains intact thereby containing not only the beverage containers, but the ice 14 and any water which may melt within the carton 12 thereby avoiding or minimizing drainage from the carton 12. The non-print side of the carton blank 10 may be coated with an appropriate film or other fluid barrier to enhance the retention of water within the carton as desired.

Another aspect of various embodiments of this carton 12 in the expanded configuration is that the handles 61 positioned on the opposite ends of the carton 12 remain intact and structurally functional for further transport of the carton 12 in the expanded configuration and its contents as necessary even after the dispenser panel 54 has been removed.

In general, the blank 10 may be constructed from paperboard having a caliper so that it is heavier and more rigid than ordinary paper. The blank 10 can also be constructed of other materials, such as cardboard, or any other material having properties suitable for enabling the carton 12 to function at least generally as described above. The blank 10 can be coated with, for example, a clay coating. The clay coating may then be printed over with product, advertising, and other information or images. The blank 10 may then be coated with a varnish to protect information printed on the blank 10. The blank 10 may also be coated with, for example, a moisture barrier layer, on either or both sides of the blank. The blank 10 can also be laminated to or coated with one or more sheet-like materials at selected panels or panel sections.

While various features of this invention have been described as tear lines or fold lines, such features may have other characteristics. As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of this invention for each of the tear lines to be replaced with a continuous slit, or the like. For example, a cut line can be a continuous slit or could be wider than a slit without departing from this invention.

In accordance with the exemplary embodiments, a fold line can be any substantially linear, although not necessarily straight, form of weakening that facilitates folding there along. More specifically, but not for the purpose of narrowing the scope of this invention, fold lines may include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

From the above disclosure of the general principles of this invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A blank for forming into a carton to hold a plurality of containers, the blank comprising:

a bottom panel;

a first and a second side panel, each side panel being joined along a first edge thereof to the bottom panel;

a first and a second expansion joint joined to the first and the second side panels, respectively, along a second edge spaced from the first edge;

a top panel joined to at least one of the first and second expansion joints;

a plurality of end flaps joined to selected ones of the bottom, first side panel, second side panel and top panel;

wherein the blank is foldable into the carton to contain the containers, the carton being expandable from a first configuration with the expansion joints in a collapsed configuration into a second configuration with the expansion joints in an expanded configuration with the first and second side panels each being pivoted outwardly about the respective first edge to thereby allow for a cooling medium to be added to the carton and interposed between the containers for cooling.

2. The blank of claim 1 wherein the plurality of end flaps further comprises:

a first bottom end flap and a second bottom end flap each foldably joined at opposite ends of the bottom panel; and a plurality of gusset fold arrangements each joining an edge of one of the bottom end flaps to one of the side panels to thereby allow for the associated side panel to pivot outwardly when the associated expansion joint is in the expanded configuration.

3. A blank for forming into a carton to hold a plurality of containers, the blank comprising:

a bottom panel;

a first and a second side panel, each side panel being joined along a first edge thereof to the bottom panel;

a first and a second expansion joint joined to the first and the second side panels, respectively, along a second edge spaced from the first edge;

a top panel joined to at least one of the first and second expansion joints;

a plurality of end flaps joined to selected ones of the bottom, first side panel, second side panel and top panel;

wherein the blank is foldable into the carton to contain the containers, the carton being expandable from a first configuration with the expansion joints in a collapsed configuration into a second configuration with the expansion joints in an expanded configuration to thereby allow for a cooling medium to be added to the carton and interposed between the containers for cooling;

wherein each expansion joint further comprises a pair of expansion panels foldably joined to the associated side panel.

4. The blank of claim 3 further comprising:

a dispenser panel defined at least in part by a dispenser tear line extending in the top panel such that upon tearing the dispenser tear line to remove the dispenser panel a dispenser opening is formed to allow for access to the containers in the carton.

5. The blank of claim 4 wherein the dispenser tear line extends into at least one of the expansion joints.

6. The blank of claim 3 further comprising:

a handle formed in at least selected ones of the end flaps by which a user may carry the carton formed from the blank when the carton is in both the first and second configuration.

7. The blank of claim 3 wherein the expansion panels of each expansion joint are in face-to-face juxtaposition when the blank is formed into a carton in the first configuration.

8. The blank of claim 3 wherein the top panel further comprises a first top panel and a second top panel which are joined to the first and second expansion joints, respectively, and are adapted to overlap one another when the blank is formed into a carton.

9. A package comprising:

a carton;

a plurality of containers within the carton;

wherein the carton further comprises:

(a) a bottom panel;

(b) a first and a second side panel, each side panel being joined along a first edge thereof to the bottom panel;

(c) a first and a second expansion joint joined to the first and the second side panels, respectively, along a second edge spaced from the first edge;

(d) a top panel joined to at least one of the first and second expansion joints;

(e) a plurality of end flaps joined to selected ones of the bottom, first side panel, second side panel and top panel;

wherein the carton is expandable from a first configuration with the expansion joints in a collapsed configuration into a second configuration with the expansion joints in an expanded configuration with the first and second side panels each being pivoted outwardly about the respective first edge to thereby allow for a cooling medium to be added to the carton and interposed between the containers for cooling.

10. A package comprising:

a carton;

a plurality of containers within the carton;

wherein the carton further comprises:

(a) a bottom panel;

(b) a first and a second side panel, each side panel being joined along a first edge thereof to the bottom panel;

(c) a first and a second expansion joint joined to the first and the second side panels, respectively, along a second edge spaced from the first edge;

(d) a top panel joined to at least one of the first and second expansion joints;

(e) a plurality of end flaps joined to selected ones of the bottom, first side panel, second side panel and top panel;

wherein the carton is expandable from a first configuration with the expansion joints in a collapsed configuration into a second configuration with the expansion joints in an expanded configuration to thereby allow for a cooling medium to be added to the carton and interposed between the containers for cooling;

wherein each of the containers has a longitudinal axis which is generally perpendicular to the top and bottom panels when the carton is in the first configuration and the longitudinal axes of the containers adjacent to one of the side panels are non-orthogonal to the bottom panel when the carton is in the second configuration.

11. A package comprising:

a carton;

a plurality of containers within the carton;

wherein the carton further comprises:

(a) a bottom panel;

(b) a first and a second side panel, each side panel being joined along a first edge thereof to the bottom panel;

(c) a first and a second expansion joint joined to the first and the second side panels, respectively, along a second edge spaced from the first edge;

(d) a top panel joined to at least one of the first and second expansion joints;

(e) a plurality of end flaps joined to selected ones of the bottom, first side panel, second side panel and top panel;

wherein the carton is expandable from a first configuration with the expansion joints in a collapsed configuration into a second configuration with the expansion joints in an expanded configuration to thereby allow for a cooling medium to be added to the carton and interposed between the containers for cooling;

wherein each expansion joint further comprises a pair of expansion panels foldably joined to the associated side panel.

12. The package of claim 11 wherein the plurality of end flaps further comprises:

a first bottom end flap and a second bottom end flap each foldably joined at opposite ends of the bottom panel; and a plurality of gusset fold arrangements each joining an edge of one of the bottom end flaps to one of the side panels to thereby allow for the associated side panel to pivot outwardly when the associated expansion joint is in the expanded configuration.

13. The package of claim 11 further comprising:

a dispenser panel defined at least in part by a dispenser tear line extending in the top panel such that upon tearing the dispenser tear line to remove the dispenser panel a dispenser opening is formed to allow for access to the containers in the carton.

14. The package of claim 13 wherein the dispenser tear line extends into at least one of the expansion joints.

15. The package of claim 11 further comprising:

a handle formed in at least selected ones of the end flaps by which a user may carry the carton in both the first and second configurations.

16. The package of claim 11 wherein the expansion panels of each expansion joint are in face-to-face juxtaposition when the cart is in the first configuration.

17. The package of claim 11 wherein the top panel further comprises a first top panel and a second top panel which are joined to the first and second expansion joints, respectively, and overlap one another to form the top panel.

18. A carton adapted to hold a plurality of containers comprising:

a bottom panel;

a first and a second side panel, each side panel being joined along a first edge thereof to the bottom panel;

a first and a second expansion joint joined to the first and the second side panels, respectively, along a second edge spaced from the first edge;

a top panel joined to at least one of the first and second expansion joints;

a plurality of end flaps joined to selected ones of the bottom, first side panel, second side panel and top panel;

wherein the carton is expandable from a first configuration in which it is a parallelepiped with the expansion joints in a collapsed configuration into a second configuration with the expansion joints in an expanded configuration with the first and second side panels each being pivoted outwardly about the respective first edge to thereby allow for a cooling medium to be added to the carton and interposed between the containers for cooling.

19. A carton adapted to hold a plurality of containers comprising:

a bottom panel;

a first and a second side panel, each side panel being joined along a first edge thereof to the bottom panel;

a first and a second expansion joint joined to the first and the second side panels, respectively, along a second edge spaced from the first edge;

a top panel joined to at least one of the first and second expansion joints;

a plurality of end flaps joined to selected ones of the bottom, first side panel, second side panel and top panel;

wherein the carton is expandable from a first configuration in which it is a parallelepiped with the expansion joints in a collapsed configuration into a second configuration with the expansion joints in an expanded configuration to thereby allow for a cooling medium to be added to the carton and interposed between the containers for cooling;

wherein each expansion joint further comprises a pair of expansion panels foldably joined to the associated side panel.

20. The carton of claim 19 wherein the plurality of end flaps further comprises:

a first bottom end flap and a second bottom end flap each foldably joined at opposite ends of the bottom panel; and a plurality of gusset fold arrangements each joining an edge of one of the bottom end flaps to one of the side panels to thereby allow for the associated side panel to pivot outwardly when the associated expansion joint is in the expanded configuration.

21. The carton of claim 19 further comprising:

a dispenser panel defined at least in part by a dispenser tear line extending in the top panel such that upon tearing the dispenser tear line to remove the dispenser panel a dispenser opening is formed to allow for access to the containers in the carton.

22. The carton of claim 21 wherein the dispenser tear line extends into at least one of the expansion joints.

23. The carton of claim 19 further comprising:

a handle formed in at least selected ones of the end flaps by which a user may carry the carton when the carton is in both the first and second configurations.

24. The carton of claim 19 wherein the expansion panels of each expansion joint are in face-to-face juxtaposition when the carton is in the first configuration.

25. The carton of claim 19 wherein the top panel further comprises a first top panel and a second top panel which are joined to the first and second expansion joints, respectively, and overlap one another to form the top panel.

* * * * *